United States Patent [19]

Crooks

[11] Patent Number: 4,477,111

[45] Date of Patent: Oct. 16, 1984

[54] PET WASTE PICKUP DEVICE

[76] Inventor: Sidney R. Crooks, 385 Hawthorne St., Brooklyn, N.Y. 11225

[21] Appl. No.: 320,200

[22] Filed: Nov. 12, 1981

[51] Int. Cl.[3] ..... A01K 29/00

[52] U.S. Cl. ..... 294/1 BA

[58] Field of Search ..... 294/1 B, 1 BA, 1 BB, 294/19 R, 50.8, 50.9, 55, 115; 15/104.8, 257.1, 257.6; 119/1

[56] References Cited

U.S. PATENT DOCUMENTS

| | | | |
|---|---|---|---|
| 3,446,525 | 5/1969 | Jones | 294/1 BA |
| 4,078,838 | 3/1978 | Nadratowski | 294/1 BA |
| 4,097,082 | 6/1978 | Orofino | 294/1 BA |
| 4,136,900 | 1/1979 | Thompson | 294/1 BB |
| 4,253,691 | 3/1981 | Liu | 294/1 BA |

*Primary Examiner*—Johnny D. Cherry

*Attorney, Agent, or Firm*—Goodman & Teitelbaum

[57] ABSTRACT

A pet waste pickup device having an elongated tubular member with a pair of jaws at a lower end of the tubular member. An upper sleeve on the tubular member acts through an elongated rod passing through the tubular member to open and close the jaws by a scissor-like action. A plunger extends through the tubular member and is operable by a lower sleeve to extend between an extended and retracted position. A bag is clipped into a forward end of the plunger. A skirt portion of the bag is internally coated with an adhesive material and is provided with a strippable tape thereon. The skirt portion is folded over the blades of the jaws and the tape is removed. After the waste material is scooped up into the bag by closing the blades of the jaws, the plunger is moved upwardly to its retracted position, thereby unfolding the skirt portion of the bag from the blades and simultaneously sealing the bag. The sealed bag is then disposed of by releasing it from the forward end of the plunger.

20 Claims, 9 Drawing Figures

PET WASTE PICKUP DEVICE

BACKGROUND OF THE INVENTION

The present invention relates to a sanitation apparatus, and more particularly to a pet waste pickup device.

In order to maintain a clean environment, avoid pollution and contamination of the public streets, and retain an aesthetic appearance to neighborhoods, it has become prevelant to utilize pickup devices for picking up waste material emitted by pets. In many communities, legal ordinances have been passed requiring the owners of pets to clean up after their pets in order to maintain cleanliness of the environment. As a result, numerous devices are now available for achieving this purpose. Such devices have become commonly known as "pooper scoopers".

Some of the prior art devices require contact of the user with the waste material during pickup or ejection of the waste material. These devices have not been generally accepted because of the mess and bother to the user. Furthermore, such devices have not been widely accepted because they do not automatically dispose of the bag after the waste material has been collected. Some of these devices do not permit simple operation and often, because of the complexity involved, fail to suitably scoop up and eject the waste material.

SUMMARY OF THE INVENTION

Accordingly, it is an object of the present invention to provide a pet waste pickup device which avoids many of the problems of prior art devices.

Still another object of the present invention is to provide a pet waste pickup device which utilizes disposable waste bags for collection of the waste material, and which automatically ejects the bag after collection of the waste.

Yet a further object of the present invention is to provide a pet waste pickup device which completely seals a disposable waste bag after the waste material has been collected so as to avoid contamination from the waste material, and which maintains the bag in a sealed condition until it is disposed of.

A further object of the present invention is to provide a pet waste pickup device which is easy to utilize, automatic in operation, is clean, safe, and avoids any direct contact with the waste material.

Briefly, in accordance with the present invention, there is provided a pet waste pickup device including an elongated tubular member, a pair of jaws being pivotally connected to the bottom of the tubular member. An actuator mechanism on the tubular member is provided for opening and closing of the jaws to thereby open and close the mouth of an inverted, disposable waste bag positioned between the jaws. A plunger extending from the tubular member releasably holds the inverted disposable bag and axially moves between an extended position and a retracted position. In the extended position, the plunger holds the bag between the jaws so that the jaws can suitably open and close the bag. In the retracted position, the bag is extracted from between the jaws and retained in a sealed condition. A release mechanism is coupled to the plunger for releasing the bag from the plunger to thereby dispose of the bag with the waste material therein.

The disposable waste bag includes adhesive material internally disposed around a skirt portion thereof adjacent to the mouth of the bag. Strippable tape covers the adhesive material. With the bag held by the plunger in the extended position, the skirt portion can be folded around the lower blades of the jaws.

With the skirt suitably folded around the blades of jaws, when waste material is to be picked up, the jaws are spread thereby opening the bag and the strippable material is removed thereby exposing the adhesive material. The device is then placed over the waste material and the jaws closed so that the blades scoop the waste material into the bag. The plunger is then drawn into its retracted position to unfold the skirt portion from about the blades. As the skirt portion squeezes between the closed blades, the adhesive material seals the mouth of the bag. The bag is then retained hanging from the plunger until it can be disposed of. Upon operation of the release mechanism, the bag is automatically dropped from the device.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which:

FIG. 8 is a fragmented elevational view similar to that shown in FIGS. 6 and 7 showing a still further step, specifically showing the sealing of the bag and the hanging thereof until it can be disposed of.

In the various figures of the drawing, like reference characters designate like parts.

DETAILED DESCRIPTION OF THE PREFERRED EMBODIMENT

Figure 1:
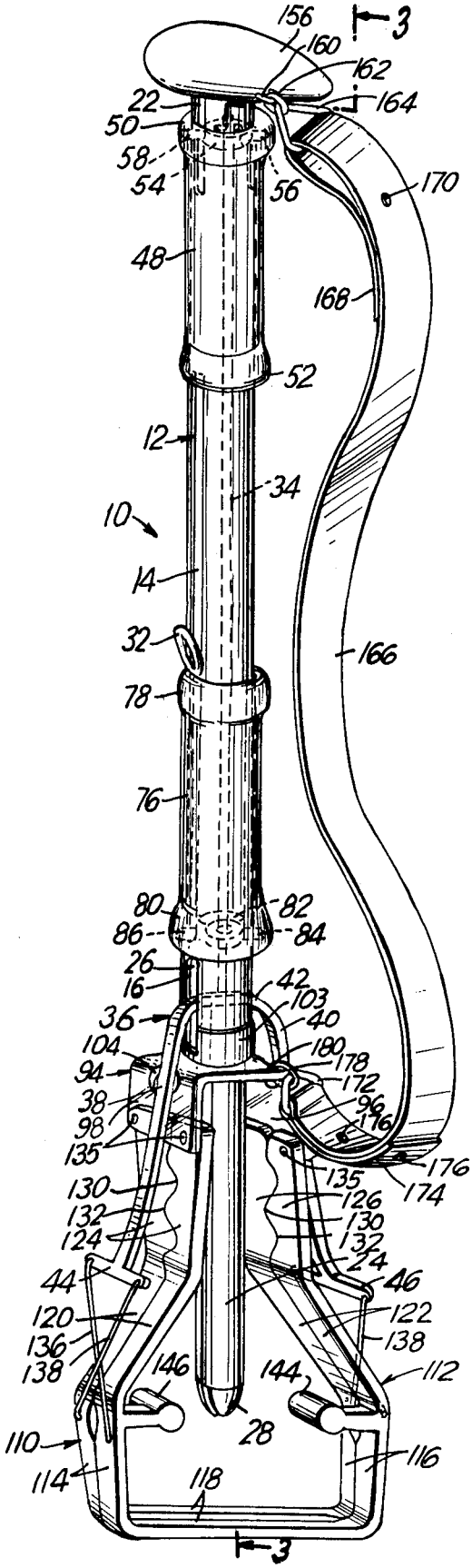
FIG. 1 is a perspective view of the pet waste pickup device in accordance with the present invention.
Figure 2:
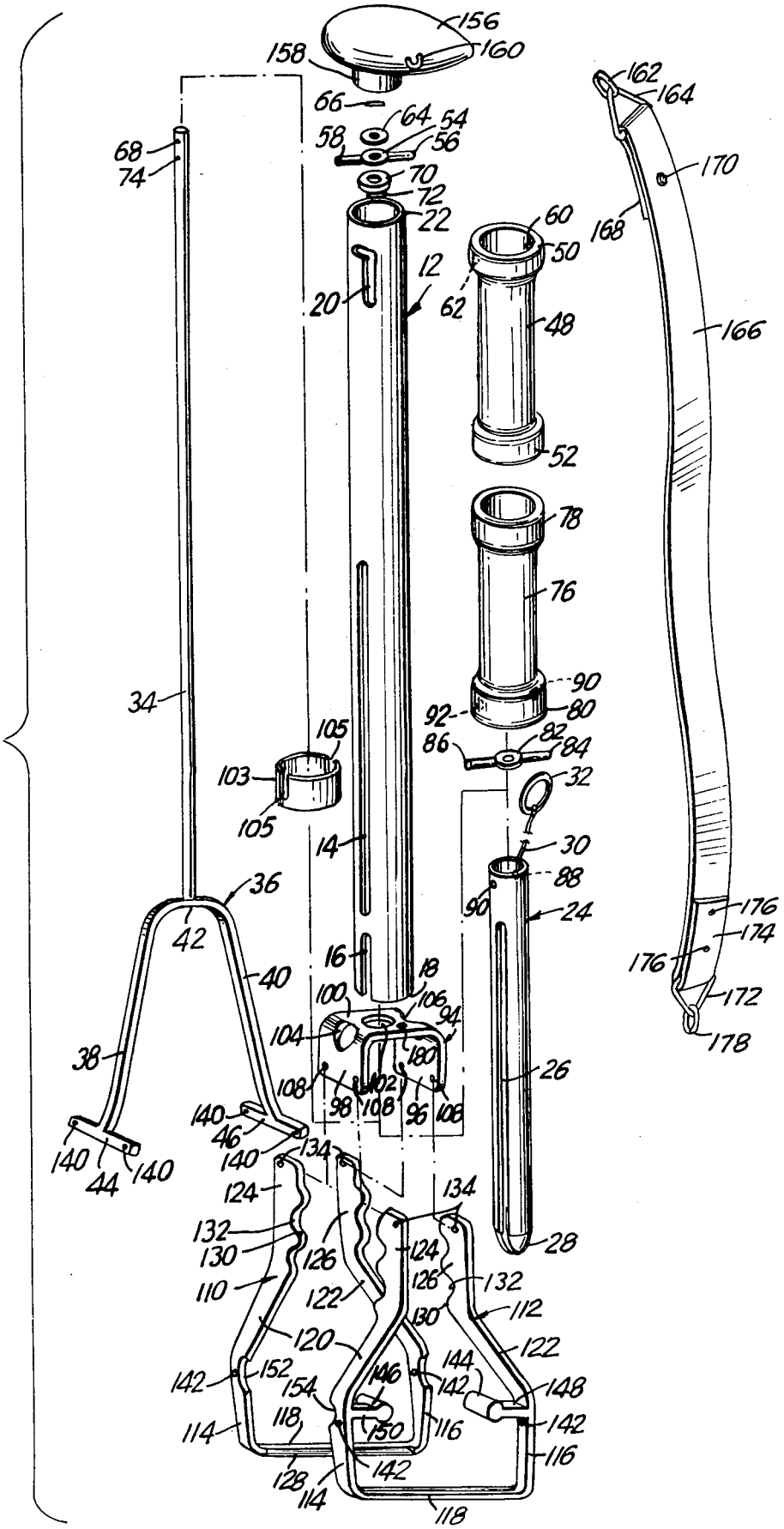
FIG. 2 is an exploded view of the various parts forming the device of the present invention.
Figure 3:
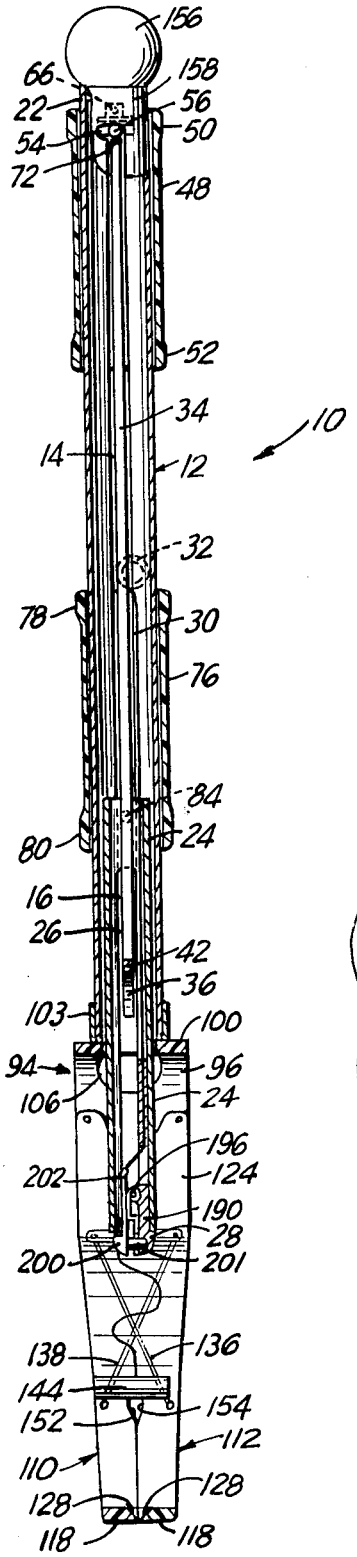
FIG. 3 is a sectional view taken along lines 3—3 of FIG. 1.

Referring now to the drawings, and especially to FIGS. 1-3, the pet waste pickup device of the present invention is shown generally at 10 and includes a tubular member 12 having a pair of elongated slots 14 formed in the lower half of the tubular member. A pair of open ended slots 16 coaxial with the elongated slots 14, are spaced therefrom and continue to the lower end 18 of the tubular member. Adjacent the upper end 22 there is provided a pair of keyway slots 20. Each of the pairs of slots shown are aligned and extend through opposing walls of the tubular member.

A hollow shaft 24 is slidably positioned within the tubular member 12 and includes a pair of elongated slots 26 through opposing walls thereof and extending for almost the entire length of the shaft 24. The lower end 28 of the shaft 24 is conically tapered and includes a releasing mechanism which will hereinafter be described. A wire 30 extends from the releasing mechanism and terminates in a pull ring 32. The wire 30 passes through the shaft 24.

An elongated rod 34 terminates at its lower end in a substantially U-shaped member 36 having outwardly flared legs 38, 40 interconnected by a bight portion 42. The legs terminate in transverse feet 44, 46 which are substantially perpendicular to the legs 38, 40.

The rod 34 passes through the shaft 24 with the bight portion 42 riding in the slots 26 of the shaft 24. The bight portion 42 also passes through the open ended slots 16 in the tubular member 12. The rod 34 continues upwardly from the top of the shaft 24 and into the upper portion of the tubular member 12. The rod 34 is of such a length as to extend almost to the top of the tubular member 12. The shaft 24, on the other hand, extends only partway up the height of the tubular member 12, essentially only until approximately the upper limit of the elongated slot 14 when fully inserted therein with the bottom portions of the shaft and tubular member being at the same level, for the reason set forth below.

An upper sleeve 48 is slidably positioned around the tubular member 12. The upper and lower ends of the sleeve 48 have a bell mouth 50, 52.

A washer 54 having laterally extending pins 56, 58 is positioned on the rod 34 with the pins 56, 58 extending laterally through the keyway slots 20, the ends of the pins being captured in the recesses 60, 62 provided in the upper bell mouth 50 of the sleeve 48. The captured washer 54 has a floating washer 64 thereabove which is held by a pin 66 which extends through the aperture 68 in the upper end portion of the rod 34. Similarly, below the captured washer 54 is a floating washer 70 held in place by means of a pin 72 which extends through the aperture 74 also in the upper end portion of the rod 34.

By means of this pin engagement assembly, the captured washer 54 is sandwiched between the pins 66 and 72 so that as the captured washer 54 is axially moved in the keyway slots 20, it moves the rod 34 axially with it. Movement of the captured washer 54 is controlled by means of the sleeve 48. The limit of the axial movement of the sleeve 48 is controlled by the vertical portion of the keyway slots 20. Thus, as the sleeve 48 rides axially up and down along the tubular member 12 with the laterally extending pins 56, 58 riding within the keyway slots 20, rod 34 moves axially within the tubular member 12. The bight portion 42 of the U-shaped member 36 at the bottom of the rod 34 at the same time will axially ride within the slots 16 and 26 of the tubular member 12 and the shaft 24, respectively.

It should be noted, that in addition to the axial movement, the sleeve 48 can have rotational movement about the tubular member 12. The rotational movement is limited by the pins 56, 58 moving within the horizontal portion of the keyway slots 20. As the sleeve 48 and captured washer 54 are rotated about the tubular member, the rod 34 will not rotate since the captured washer 54 is free to rotate relative thereto about the rod 34. However, rotation of the sleeve 48 serves to lock the rod 34 in its upward position within the tubular member 12.

A lower sleeve 76 is positioned near the bottom of the tubular member 12 and also includes upper and lower bell mouths 78, 80. A captive washer 82 having laterally extending pins 84, 86 is positioned within the upper end of the shaft 24 with the pins 84, 86, extending through the apertures 88, 90, in the shaft 24 and continuing through the slots 14 to be captured in recesses 90, 92 in the lower bell mouth 80 of the sleeve 76.

In this manner, as the sleeve 76 rides up and down about the outside surface of the tubular member 12, it causes the captive washer 82 and the shaft 24 to also move upwardly and downwardly within the tubular member 12. This axial movement is limited by the pins 84, 86 riding within the slots 14 so that the upper and lower limits are provided by the upper and lower ends of the elongated slots 14.

During the axial movement of the shaft 24, the bight portion 42 of the U-shaped member 36 remains stationary because it extends through the slots 26 to avoid any interference with the movement of the shaft 24.

Connected at the bottom of the tubular member 12 is a yoke member 94 including downward depending legs 96, 98 and a bight portion 100 interconnecting the legs. An aperture 102 is formed at the center of the bight portion 100 to permit passage therethrough of the shaft 24. Cutouts 104, 106 are provided on the sides of the yoke to accommodate and guide the movement of the legs 38, 40 of the U-shaped member 36 over the yoke. An upper collar 103 having opposing slots 105 is secured on the bight portion 100 of the yoke 94 to receive the bottom end of the tubular member 12 to secure the yoke to the tubular member, the collar slots 105 being in alignment with the tubular member slots 16. Four holes 108 are formed at the lower ends of the yoke legs 96, 98 to receive rivets which interconnect a pair of jaws 110, 112 to the yoke 94.

Each of the jaws 110, 112 includes lower legs 114, 116 interconnected by a bottom blade portion 118. Upwardly from the legs 114, 116, the jaws extend inwardly along sections 120, 122 and terminate in the upwardly extending neck sections 124, 126. The abutting edges of the blades 118 are formed into knife edges 128, as can best be seen in FIG. 3. The neck portions 124, 126 include an undulating surface having ridges 130 and valleys 132 which matingly intermesh between the two jaws so as to provide a suitable engaging surface, as can best be seen in FIG. 1.

At the upper ends of the neck portions 124, 126, there are provided holes 134 which align with the holes 108 of the yoke for receiving the rivets 135 to pivotally connect the jaws to the yoke.

Movement of the jaws 110, 112 is controlled by means of the scissor arranged wires 136, 138 which crisscross each other. These wires are positioned on both lateral sides of the jaws 110, 112. The scissor wires 136, 138 extend from the distal ends of the feet 44, 46, passing through and being secured in the apertures 140 in the feet. The lower ends of the scissor wires 136, 138 fit into and are secured in the apertures 142 provided on the legs 114, 116 of the jaws. Stabilizing posts 144, 146 are supported by arms 148, 150 which are connected to the legs 114, 116 of one of the jaws, such as jaw 112, and extend toward the other jaw 110. Opposing cutouts 152, 154 are formed on opposing leg portions of the jaws in order to prevent pinching of the disposable waste bag, as will hereinafter be explained.

Figure 6:
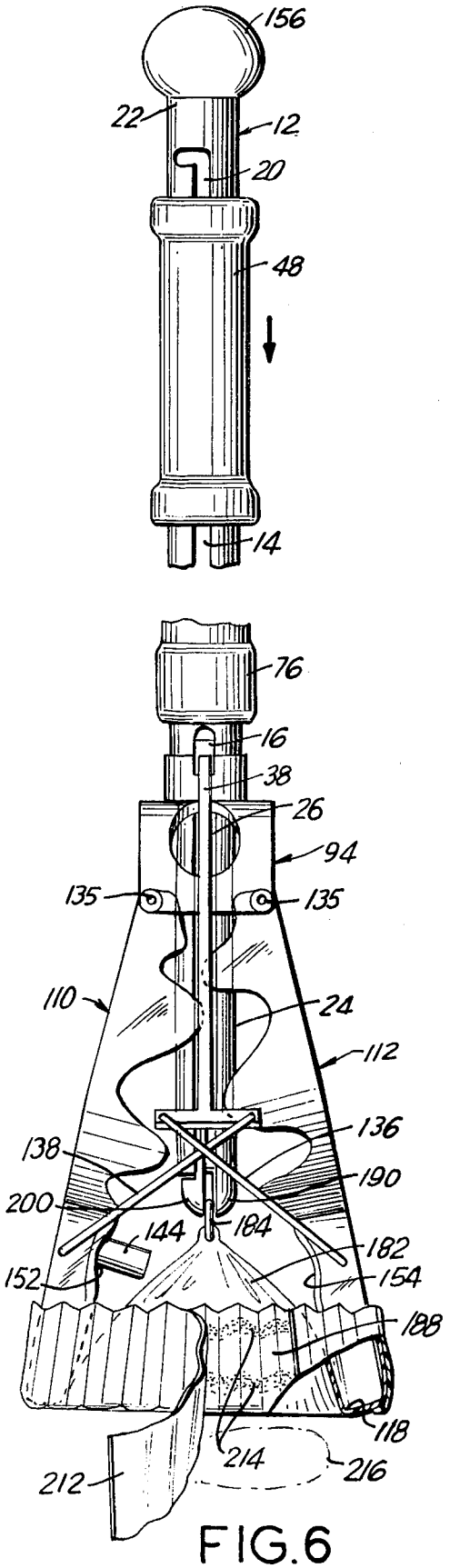
FIG. 6 is a fragmented elevational view showing one of the early steps in utilizing the device, specifically in preparing the bag for utilization in collecting waste material.
Figure 7:
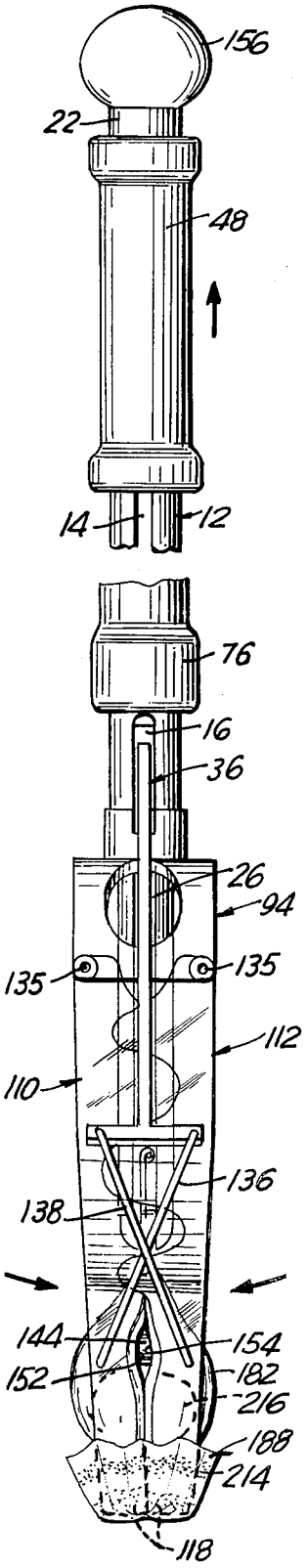
FIG. 7 is a fragmented elevational view similar to that shown in FIG. 6 showing a later step in the utilization of the device, specifically after collection of the waste material into the disposable bag.

As the upper sleeve 48 moves axially, the rod 34 will likewise move axially. At the upper limit, the rod pulls the scissor wires upwardly to close the scissor wires 136, 138 thereby closing the pivotal jaws, bringing together the two blades 118 into an abutting relationship, as best shown in FIG. 7. When the sleeve 48 is lowered, the rod 34 moves downwardly and pushes the scissor wires downwardly causing the scissor wires 136, 138 to spread apart, thereby opening the pivotal jaws, as best shown in FIG. 6. During this movement, some lateral spreading of the legs 38, 40 may occur, which is controlled by the openings 104, 106 in the yoke 94 on which the legs 38, 40 ride.

At the upper end of the tubular member 12, there is connected a handle 156 having a neck portion 158 which securely fits into the upper end 22 of the tubular member 12. A hook 160 is provided on the handle 156 to which is connected a closed loop 162 extending from a bale 164 attached to a shoulder strap 166 by means of an overlapping hem portion 168 held in place by means of a rivet 170. At the lower end of the strap 166, another bale 172 is likewise held in place by means of an overlapping hem 174 held in place by means of rivets 176. A lower closed loop 178 extending from the bale 172 is attached in an aperture 180 formed in the bight portion 100 of the yoke member 94. By means of the strap 166, the device can be carried about on an individual's shoulder.

Figure 4:
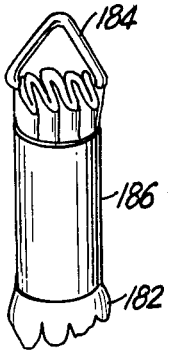
FIG. 4 is a perspective view showing a disposable waste bag held in a folded stored condition.
Figure 5:
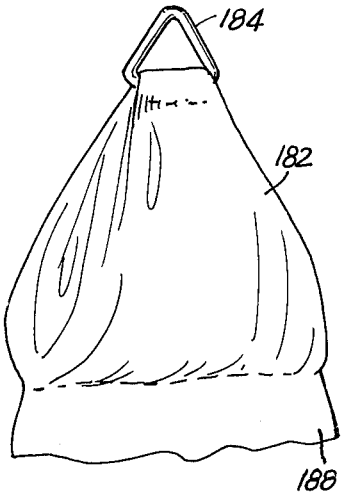
FIG. 5 is a perspective view of a disposable waste bag in its open condition before it has been positioned on the device.

The disposable waste bag 182 that is utilized in conjunction with the device can be initially stored in a folded fan-like arrangement, as shown in FIG. 4. At the upper end of the bag 182, there is provided a bale 184 for hooking onto the device. The bag 182 is retained in the folded condition by means of a sleeve 186 which fits around the bag and holds it together. When the bag 182 is to be used, the sleeve 186 is removed so that the bag will unfold and open into a triangular configuration, as shown in FIG. 5. The lower end of the bag 182 adjacent its mouth includes a skirt portion 188 which has a self-sticking adhesive material disposed internally about the skirt and includes a strippable tape over the adhesive material, as will be set forth below.

Figure 9:
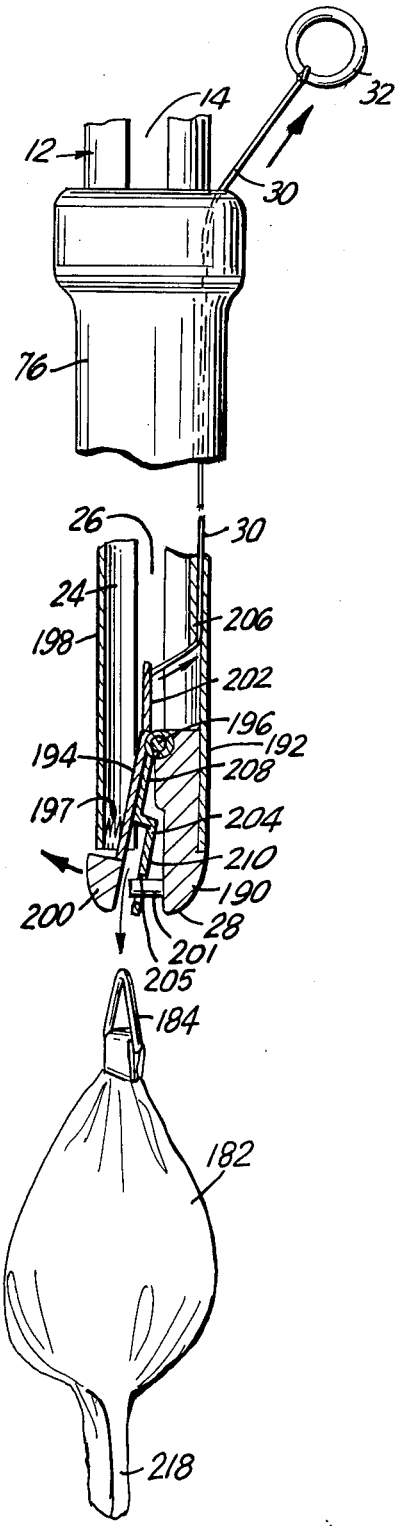
FIG. 9 is a fragmented elevational view showing the step in the release and ejection of the sealed bag containing the waste material therein.

Referring now to FIG. 9, it will be noted that at the forward end 28 of the shaft 24, there is provided a plug 190 forming the conical front portion and which sits into the hollow of the shaft, being connected onto one wall 192 thereof. A leg 194 is pivotally connected to the plug 190 by means of the pivot pin 196 and is normally biased into a closed position adjacent the plug 190 by means of the spring 197 positioned between the leg 194 and the wall 198 of the shaft 24. At the forward end of the leg 194 there is provided a conical end 200 matching the conical shape 28 of the plug 190. A post 201 laterally extends from the plug 190 on which the bale 184 of the bag 182 is placed and is held in position by means of the biased leg 194.

The releasing wire 30, which has its upper end connected to the releasing loop 32, has its lower end connected to a lever arm 202 which is disposed around the hinge pin 196 and extends into a releasing arm 204. The releasing arm 204 has a stepped shaped configuration to conform to the stepped shape of the plug 190. A hole 205 is formed in the lower end of the releasing arm 204 to permit passage therethrough of the post 201.

When the releasing loop 32 is pulled upwardly, it correspondingly pulls on the wire 30. The wire 30 passes beneath a shoulder portion 206 so that it moves the lever arm 202 toward the right, as shown in FIG. 9, which causes the releasing arm 204 to move to the left. Ths action causes the upper part 208 of the releasing arm 204 to move against the leg 194, thereby opposing the biasing force of the spring 197, and thus causes the lower portion 210 of the releasing arm 204 to push the bale 184 off the post 201, and thereby ejecting the waste bag 182 from the device. It is noted, that the leg 194 can be secured to the upper part 208 of the releasing arm 204 and will function in the same above manner.

In operation of the device, the bag 182 is initially attached to the lower end of the shaft 24, as shown in FIG. 6, by hooking the bale 184 of the bag 182 onto the post 201. The upper sleeve 48 is moved downwardly along the tubular member 12. The U-shaped member 36 correspondingly moves downwardly within the slots 16 and 26 causing the scissor wires 136, 138 to pivotally open the jaws 110, 112 so that the lower blade portions 118 are spaced apart. The lower sleeve 76 is also moved downwardly to lower the shaft 24 to its extended position, whereby the bag 182 is moved into its lowermost position and is situated between the jaws 110, 112. The skirt portion 188 of the bag 182 is then folded upwardly and outwardly around the blades 118 so that the strippable tape 212 is exposed, as shown in FIG. 6. The device is now in a position to be utilized for collection of waste material.

When waste material is ready to be picked up, the strippable tape 212 is removed from the folded over skirt portion 188 to expose the self-sticking adhesive 214 therebeneath. The device is then positioned over the waste material 216 so that the folded edges of the bag touch the ground around the waste material, and the upper sleeve 48 is slid upwardly along the tubular member 12, as shown in FIG. 7. By moving the sleeve 48 upwardly, as the device rests on the ground, the U-shaped member 36 moves upwardly in the slots 16, 26 as the rod 34 also moves upwardly within the tubular member 12, thus causing the scissor wires 136, 138 to pivotally close the jaws 112, 110 together. As the jaws are brought together, the blade portions 118 at the lower edge of the jaws will scoop up the waste material and bring it up into the bag 182 which is positioned on the jaws. The waste material 216 will enter the bag 182 as the mouth of the bag is being closed by means of the closing jaw blades 118. During this closing operation, the jaw cutouts 152, 154 prevent the bag from being pinched by the closing jaws. The sleeve 48 at its uppermost position is now rotated to lock the sleeve 48 in place, in the manner set forth above.

Figure 8:
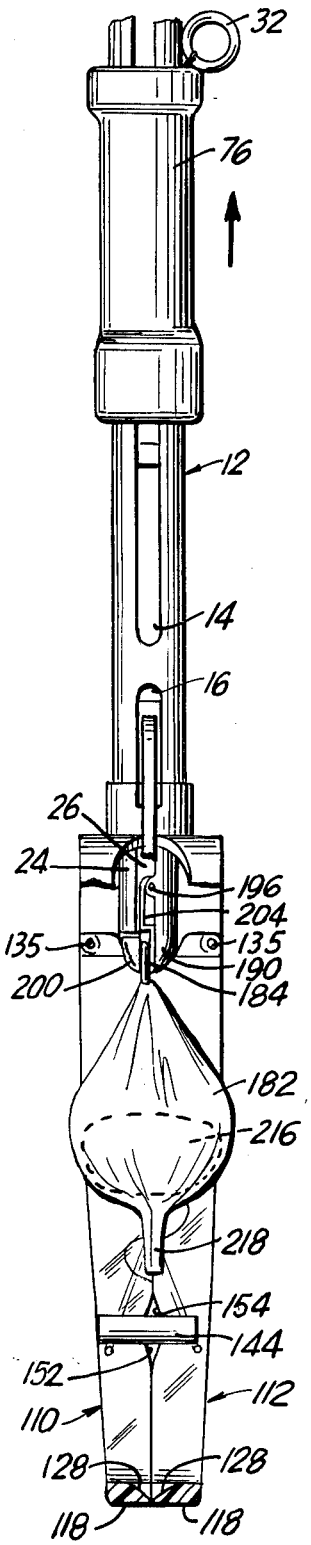

Referring now to FIG. 8, the lower sleeve 76 is then moved upwardly along the tubular member 12 so that the shaft 24 moves within the tubular member 12 into its retracted position. As the shaft 24 moves upwardly, it pulls upwardly therewith the bag 182 containing the waste material 216, so that the previously folded over skirt portion 188 unfolds from around the blades 118 and is squeezed together between the pressing blades 118. The adhesive material 214 on the skirt portion is sealed together as the skirt portion 188 is squeezed through the blades thereby sealing the mouth 218 of the bag 182. The bag is guided upwardly by means of the guide posts 144, 146 which stabilize the bag and assist in guiding it upwardly for proper sealing thereof.

The device now can be carried with the filled bag hanging down from the shaft 24, wherein the bag is free to hang between the open sides of the jaws 110, 112. When the device is brought to a proper disposal location, the device is placed over a disposal unit and the ring 32 is pulled, preferably upwardly, as shown in FIG. 9, to cause the bag 182 to be dropped from the end of the shaft 24, and thus is automatically disposed of by the device. It is noted, that as the releasing arm 204 pivots due to the action of the wire 30, the lower portion 210 pushes the bale 184 of the bag off the post 201. The device is then ready for placing another disposable bag in position for further utilization of the device. Accordingly, the bale 184 of the new bag is inserted between the lower portion 210 and the end 200 of leg 194, whereby the end 200 is pushed against the bias of the spring 197 so that the bale 184 can be mounted on the post 201. Once on the post, the spring 197 forces the end 200 against the post 201 to secure the new bag thereon.

It is therefore appreciated that the device provides for automatic ejection of the waste-filled bag as well as for an efficient pickup of the waste material without having the user come in direct contact with the waste material. Furthermore, during the time that the waste material is held in the pickup device, it is retained in a sealed bag so that no smell will be emitted from the waste material, and there is no opportunity for any of the waste material to fall out of the sealed bag. Accordingly, the pickup device is not only efficient and simple to operate, but provides an extremely clean environment and avoids any annoyance to the user.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A pet waste pickup device comprising:
an elongated tubular member;
a pair of jaws pivotally connected to a bottom portion of said tubular member;
actuator means on said tubular member for pivotally opening and closing said jaws to thereby open and close a mouth of an inverted disposable waste bag positioned thereon;
plunger means on said tubular member for releasably retaining the inverted disposable bag, said plunger means being axially movable between an extended position wherein the bag is positioned folded about the jaws and a retracted position wherein the bag is extracted from about the jaws with its mouth being sealed;
release means coupled to said plunger means for releasing the sealed bag from said plunger means; and
said actuator means including a rod slidably disposed within said tubular member and terminating at its lower end in a pair of arms extending below said tubular member, a scissor-like mechanism interconnecting each arm with a respective opposing side of said pair of jaws, a sleeve slidably mounted on said tubular member, and coupling means for coupling said sleeve to said rod, whereby axially sliding of said sleeve upwardly and downwardly with respect to said tubular member causes said scissor-like mechanism to operate so as to respectively close and open said jaws.

2. A pet waste pickup device as claim 1, and further comprising a disposable waste bag having self-sticking adhesive material disposed internally around a skirt portion of said bag adjacent the mouth of the bag, and strippable tape means covering said adhesive material, said skirt portion being capable of being folded about the jaws so as to be manipulated thereby.

3. A pet waste pickup device as in claim 2, wherein said pair of jaws includes opposing blades abutting each other in a closed jaw position, and wherein, with said skirt portion folded over said blades, said device includes first means for unfolding said skirt portion from about said blades during the raising of said plunger means to its retracted position, and second means for squeezing the mouth of the bag between the closed blades to cause the adhesive material to seal the bag.

4. A pet waste pickup device as in claim 3, wherein said blades define a bottom of said pickup device, abutting edges of said blades having a knife-edge formation for scooping of waste material.

5. A pet waste pickup device as in claim 2, wherein said bag is substantially triangular in shape with the mouth of the bag being at its base, and further comprising hook means coupled to an apex of the bag for coupling to said plunger means.

6. A pet waste pickup device as in claim 5, wherein said bag is collapsible in a folded fan-like arrangement, and further comprising a covering sleeve for holding the bag in its collapsed state.

7. A pet waste pickup device as in claim 1, wherein said coupling means includes a pair of pins rotatively secured to said rod and captured within said sleeve, and a pair of elongated slots in said tubular member in which said pins can ride.

8. A pet waste pickup device as in claim 7, wherein said sleeve and pins are rotatable with respect to said tubular member, and wherein each of said slots is part of an L-shaped keyway provided in said tubular member, whereby said jaws can be locked in a normally closed position.

9. A pet waste pickup device as in claim 1, wherein said plunger means includes a hollow shaft slidably disposed within said tubular member, said rod being slidably disposed within said shaft, and further comprising a second sleeve slidably mounted on said tubular member, and second coupling means for coupling said second sleeve to said shaft whereby axially sliding upwardly and downwardly of said second sleeve with respect to said tubular member causes said plunger means to respectively move between its retracted and extended positions.

10. A pet waste pickup device as in claim 9, wherein said second coupling means includes a pair of pins extending through said shaft and captured within said second sleeve, and elongated slots in said tubular member in which the pins can ride.

11. A pet waste pickup device as in claim 9, and further including elongated slots provided in said shaft for receiving said pair of arms, whereby said shaft can axially slide with respect to said jaws.

12. A pet waste pickup device as in claim 9, wherein said first mentioned sleeve is positioned on an upper portion of said tubular member and said second sleeve is positioned on a lower portion of said tubular member.

13. A pet waste pickup device as in claim 1, and further comprising a handle at a top end of said tubular member, and a shoulder strap extending from said handle to said bottom portion of said tubular member.

14. A pet waste pickup device comprising:
an elongated tubular member;
a pair of jaws pivotally connected to a bottom portion of said tubular member;

actuator means on said tubular member for pivotally opening and closing said jaws to thereby open and close a mouth of an inverted disposable waste bag positioned thereon;

plunger means on said tubular member for releasably retaining the inverted disposable bag, said plunger means being axially movable between an extended position wherein the bag is positioned folded about the jaws and a retracted position wherein the bag is extracted from about the jaws with its mouth being sealed;

release means coupled to said plunger means for releasing the sealed bag from said plunger means;

a spring biased clip disposed at a forward end of said plunger means for retaining the inverted disposable waste bag; and said release means including a hinged lever for opening said clip, and wire means coupled to said hinged lever and extending upwardly along tubular member to a suitable actuating location, whereby pulling of said wire opens said clip.

15. A pet waste pickup device as in claim 14, and further comprising a disposable waste bag having self-sticking adhesive material disposed internally around a skirt portion of said bag adjacent the mouth of the bag, and strippable tape means covering said adhesive material, said skirt portion being capable of being folded about the jaws so as to be manipulated thereby.

16. A pet waste pickup device as in claim 15, wherein said pair of jaws includes opposing blades abutting each other in a closed jaw position, and wherein, with said skirt portion folded over said blades, said device includes first means for unfolding said skirt portion from about said blades during the raising of said plunger means to its retracted position, and second means for squeezing the mouth of the bag between the closed blades to cause the adhesive material to seal the bag.

17. A pet waste pickup device as in claim 16, wherein said blades define a bottom of said pickup device, abutting edges of said blades having a knife-edge formation for scooping of waste material.

18. A pet waste pickup device as in claim 15, wherein said bag is substantially triangular in shape with the mouth of the bag being at its base, and further comprising hook means coupled to an apex of the bag for coupling to said clip.

19. A pet waste pickup device as in claim 18, wherein said bag is collapsible in a folded fan-like arrangement, and further comprising a covered sleeve for holding the bag in its collapsed state.

20. A pet waste pickup device as in claim 14, and further comprising a handle at a top end of said tubular member, and a shoulder strap extending from said handle to said bottom portion of said tubular member.

* * * * *